US009159183B2

(12) United States Patent
Striebel

(10) Patent No.: US 9,159,183 B2
(45) Date of Patent: Oct. 13, 2015

(54) VENDING DEVICE

(71) Applicant: KK Manufacturing, LLC, South Windsor, CT (US)

(72) Inventor: Paul Striebel, South Windsor, CT (US)

(73) Assignee: KK Manufacturing, LLC, South Windsor, CT (US)

( * ) Notice: Subject to any disclaimer, the term of this patent is extended or adjusted under 35 U.S.C. 154(b) by 75 days.

(21) Appl. No.: 13/741,699

(22) Filed: Jan. 15, 2013

(65) Prior Publication Data

US 2013/0186907 A1 Jul. 25, 2013

Related U.S. Application Data

(60) Provisional application No. 61/588,854, filed on Jan. 20, 2012.

(51) Int. Cl.
*G07F 11/54* (2006.01)
*G07F 13/10* (2006.01)

(52) U.S. Cl.
CPC ..... *G07F 11/54* (2013.01); *G07F 13/10* (2013.01)

(58) Field of Classification Search
USPC ..... 221/69, 119, 121, 191, 195, 209, 277
See application file for complete search history.

(56) References Cited

U.S. PATENT DOCUMENTS

| | | | | | |
|---|---|---|---|---|---|
| 1,732,990 | A * | 10/1929 | Smith | 221/82 |
| 3,341,269 | A * | 9/1967 | Weitzman | 312/205 |
| 4,978,032 | A | 12/1990 | Newman | |
| 5,080,257 | A | 1/1992 | Carnisio | |
| 5,244,071 | A | 9/1993 | Lobl | |
| 5,337,876 | A * | 8/1994 | McGee et al. | 194/236 |
| D370,694 | S | 6/1996 | Kovens | |
| 7,367,472 | B2 | 5/2008 | Simson | |
| 7,401,710 | B2 | 7/2008 | Black | |
| 8,025,180 | B2 * | 9/2011 | Magno | 221/196 |
| 2005/0082308 | A1 * | 4/2005 | Simson | 221/105 |
| 2012/0080444 | A1 * | 4/2012 | Smith et al. | 221/208 |

* cited by examiner

*Primary Examiner* — Gene Crawford
*Assistant Examiner* — Kelvin L Randall, Jr.
(74) *Attorney, Agent, or Firm* — UConn IP Law Clinic; Susan K. Pocchiari; Alicia J. Esposito

(57) ABSTRACT

A machine having a machine housing and a machine base defining a housing axis. The machine housing has a top cover and a bottom cover including a hub with a shaped hole. A removable carousel is disposed within the machine housing along the machine axis with a plurality of tubes oriented parallel to the housing axis. The machine base has an interior and an exterior, and is operatively connected to the machine housing proximate the bottom cover. A mechanical mechanism is disposed partially in the interior of the machine base having an internal actuator cam, and a cam follower assembly, wherein the internal actuator cam and the cam follower are operatively connected to one another. The machine includes an ejector arm operatively interfaced with the mechanical mechanism, and a discharge chute disposed within the machine base including a first end and a second end.

19 Claims, 7 Drawing Sheets

VENDING DEVICE

CROSS-REFERENCE TO RELATED APPLICATIONS

This application claims priority to U.S. Provisional Patent Application No. 61/588,854, filed Jan. 20, 2012, entitled VENDING DEVICE which is incorporated herein by reference in its entirety:

TECHNICAL FIELD

The present invention is generally directed to vending devices. More particularly, the present invention is directed to a machine or device capable of dispensing goods or substances enclosed in containers such as those commonly used for single servings of coffee, tea, hot chocolate and apple cider.

BACKGROUND OF THE INVENTION

The coffee service industry presently offers an abundant assortment of beverages that are packaged in small single serve containers and designed to be easily inserted into a brewing system. The containers are frequently offered and displayed in an uncontrolled manner around the brewing system for the convenience of the consumer.

Because of the value associated with the container and its contents, it is becoming increasingly desirous to control the inventory and dispensing of the containers. The current system of displaying the containers in bulk in an unsecured environment, often around the brewing system, is unfortunately subject to theft and abuse.

From the above, it is therefore seen that there exists a need in the art to overcome the deficiencies and limitations described herein and above, and provide for a manner of conveniently controlling and dispensing small containers, products, and articles of value.

SUMMARY OF THE INVENTION

The shortcomings of the prior art are overcome and additional advantages are provided through a machine for storing, displaying and selectively dispensing a plurality of items.

The present invention provides a machine having a machine housing defining a housing axis. The machine housing has a top cover and a bottom cover, the bottom cover including a hub. The machine also includes a machine base operatively connected to the machine housing proximate the bottom cover. The machine base has an interior and an exterior. It is further contemplated that the machine includes a carousel disposed within the machine housing along the housing axis. The carousel has a plurality of tubes oriented parallel to the housing axis. The machine also has a mechanical mechanism disposed partially in the interior of the machine base. The mechanical mechanism has an internal actuator cam, and a cam follower assembly, wherein the internal actuator cam and the cam follower are operatively connected to one another. The machine further includes an ejector arm operatively connected to the mechanical mechanism within the machine base. The mechanical mechanism is configured and adapted to rotate the ejector arm about an ejector arm axis into the machine housing, whereby the rotation of the ejector arm is configured to eject an item from the one of the plurality of tubes. It is also contemplated that the machine includes a discharge chute disposed within the machine base, the discharge chute including a first end and a second end, the first end disposed inside of the machine base and the second end outside of the machine base, the discharge chute configured and adapted to provide passage for an item from the plurality of tubes and hub, through the discharge chute to dispense outside of the machine base.

In another aspect, the machine can include a turn knob operatively connected to the carousel, configured to mechanically move the carousel. The machine can also include a key lock connected to a central tie rod proximate the top cover and operatively connected to the machine housing. The key lock is configured to control access to the housing interior. In addition, the mechanical mechanism can include a coin mechanism proximate the exterior of the machine base, where the internal actuator cam, the coin mechanism, and the cam follower are operatively connected to one another. The coin mechanism is configured and adapted to interface with a user and control the internal actuator cam and cam follower assembly, ultimately interfacing with the ejector arm. The ejector arm is configured and adapted to push a selected item out of one of the plurality of tubes and into the hub. The hub can include a shaped hole that is configured and adapted to allow one of the items being dispensed to pass through the shaped hole. The hub can also include a retainer element operatively connected to the hub proximate the shaped hole of the hub. The retainer element configured and adapted to resist an item from passing through the shaped hole. The machine can also include a coin box proximate the interior of the machine base. The coin box is configured and adapted to receive and hold a plurality of coins inserted through the coin mechanism.

In yet another aspect, the plurality of tubes can be numbered in series. The machine can also include a display module including individual compartments integrated with the machine housing. Alternatively, the display module may be proximate the machine housing. The number of individual compartments can correspond with the number of plurality of tubes. Each individual compartment is identifiable to correspond with one of the numbered tubes. Each tube of the plurality of tubes can include a first and second opposing hole. The first opposing hole is configured to allow the ejector arm to pass through, and the second opposing hole is configured and adapted to allow only one unit at a time to pass through without machine error. It is also contemplated that the second opposing hole is substantially trapezoidal. In addition, the plurality of tubes can be configured and adapted to allow for a plurality of units to move by gravity through the plurality of tubes parallel to the housing axis.

In yet another aspect, the carousel can include opposing top and bottom plates, wherein the top and bottom plates are separated by the plurality of tubes. The top plate is connected to a splined bushing that is connected to the turn knob, and has a series of equally sized and equally spaced holes. It is also contemplated that the bottom plate is ring shaped and a center hole of the bottom plate is operatively fit over the hub. In addition, the bottom plate can include a series of indents that are configured and adapted to provide proper indexing for the carousel. Further, a flat bearing surface on the bottom cover of the machine housing can include spring loaded detents. The spring loaded detents are configured and adapted to work with the indents in the bottom plate to provide indexing for the carousel. It is also contemplated that the carousel can be removable. In addition, the top cover of the machine housing can be removable and the bottom cover of the machine housing is configured and adapted to substantially divide the machine housing from the machine base. The bottom cover can also include a slot substantially aligned with the ejector arm. The slot is configured and adapted to allow the ejector arm to rotate from within the machine base into the machine housing and ultimately push a selected item out of one of the plurality of tubes and into the hub.

Additional features and advantages are realized through the techniques of the present invention. Other embodiments and aspects of the invention are described in detail herein and are considered a part of the claimed invention.

The recitation herein of desirable objects which are met by various embodiments of the present invention is not meant to imply or suggest that any or all of these objects are present as essential features, either individually or collectively, in the most general embodiment of the present invention or in any of its more specific embodiments.

BRIEF DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

DETAILED DESCRIPTION

Figure 1:
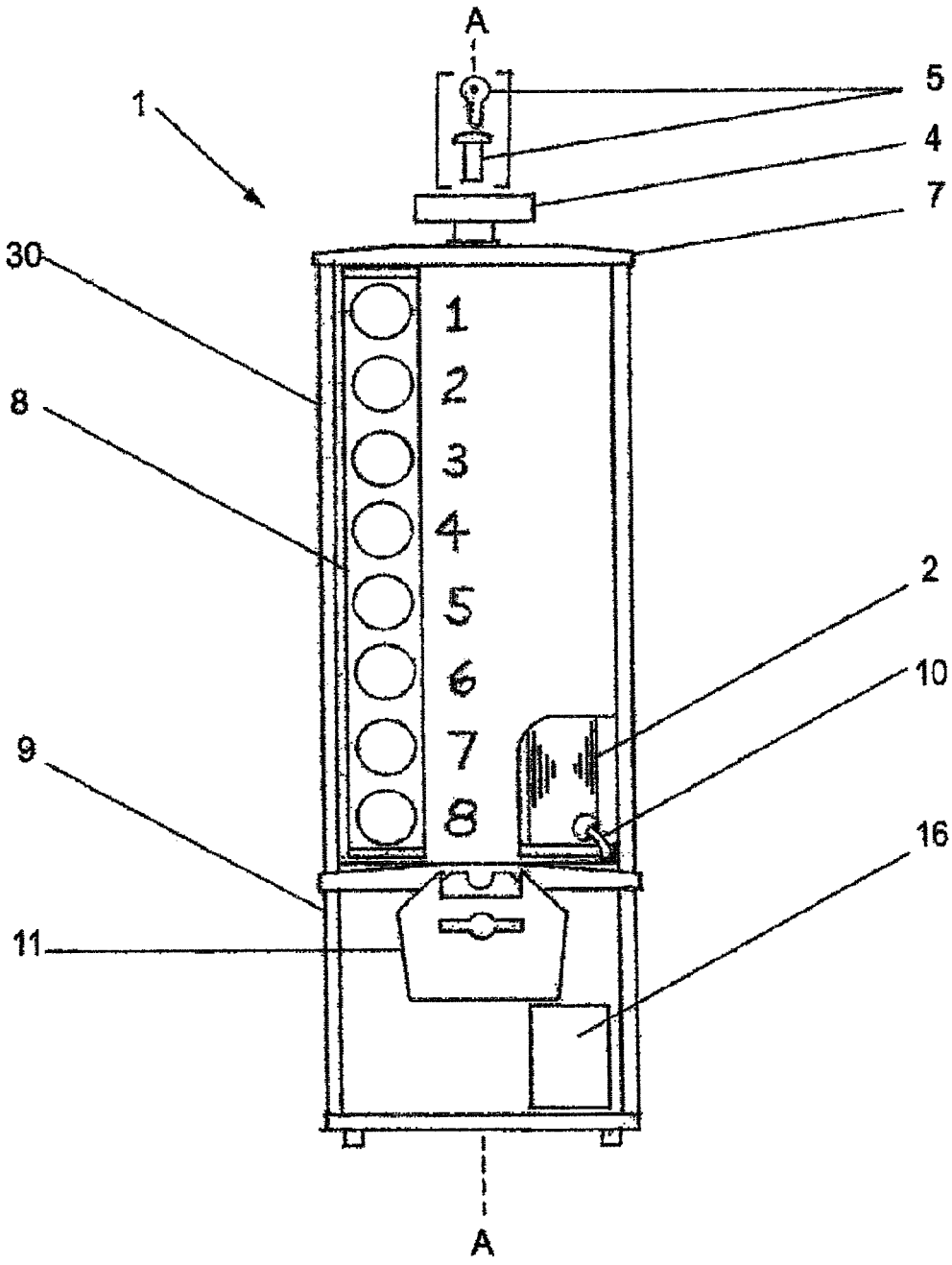
FIG. 1 is a front view of a vending machine of the present invention with an exploded view of the key lock 5 (indicated by brackets)

Referring now to the invention in more detail, as shown in FIG. 1, the present invention provides a machine, e.g. vending machine 1, having a machine housing 30 defining a housing axis A. In a preferred embodiment, machine 1 is configured to dispense a variety of products packaged and sealed in thermoformed pods. Specifically, the machine is intended to dispense individual serving containers of coffee or other beverages such as Keurig© brand K-Cups®. Machine housing 30 has a top cover 7 and a bottom cover 33, shown in FIG. 6, bottom cover 33 including a hub 25, also shown in FIG. 6. Machine 1 also includes a machine base operatively connected to machine housing 30 proximate bottom cover 33. Machine base 9 has an interior and an exterior.

Figure 2:
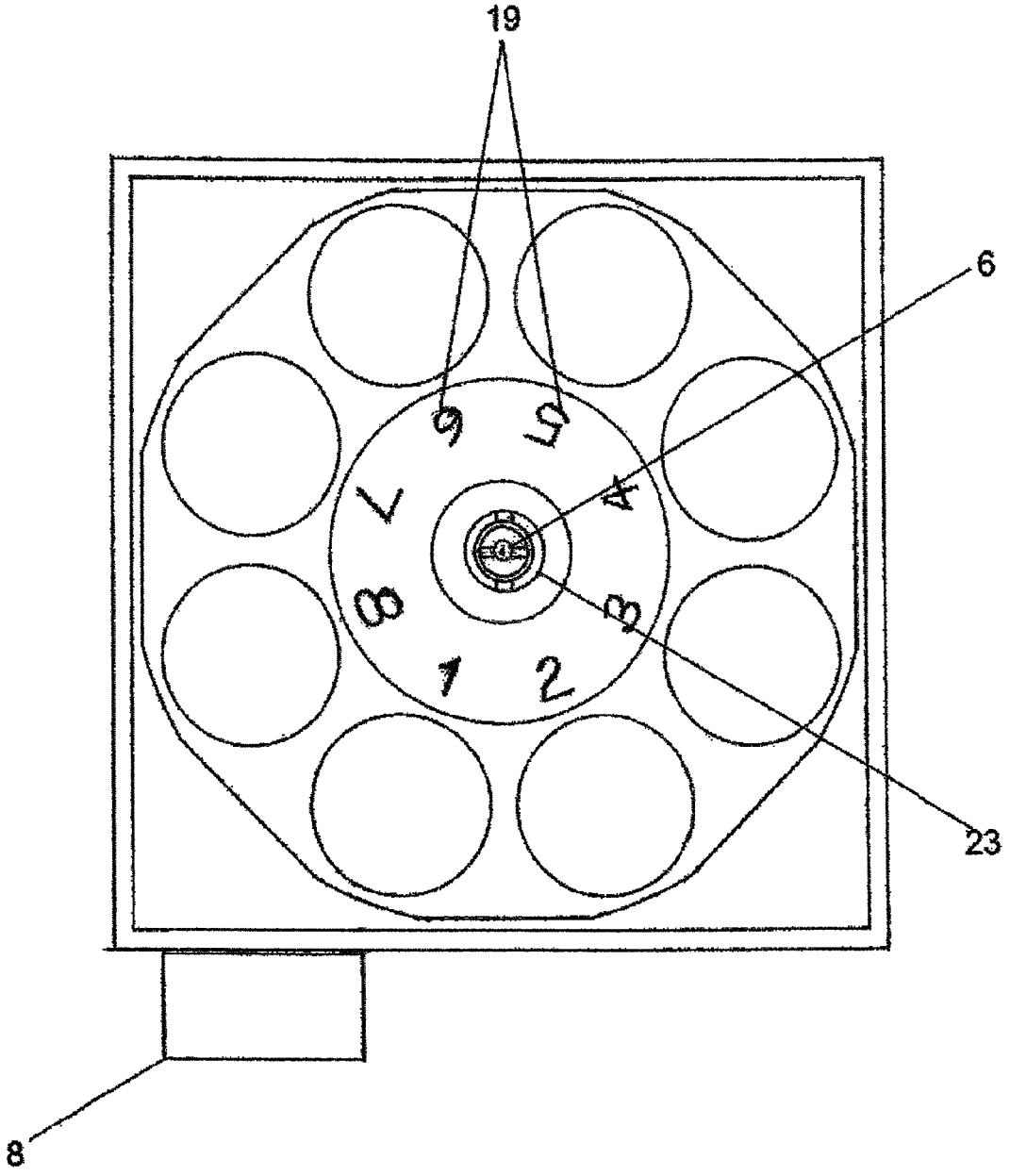
FIG. 2 is a top view of the machine with the top cover removed.

In further reference to FIGS. 1 and 2 the machine 1 includes a carousel 2 disposed within machine housing 30 along the housing axis A. Carousel 2 has a plurality of tubes 3, shown in FIG. 4, oriented parallel to housing axis A in a vertical manner. Those skilled in the art will appreciate that tubes 3, need not be oriented in a vertical manner, but can be in any suitable orientation where the units are dispensed by gravitational force. Machine 1 also includes a turn knob 4 located proximate the top of machine 1 operatively connected to carousel 2, configured to mechanically move carousel 2. Machine 1 can also include a key lock 5 embedded in the center of turn knob 4 and connected to a central tie rod 6 proximate top cover 7 and operatively connected to machine housing 30. Key lock 5 is configured to control access to the housing 30 interior. Opening key lock 5 allows for removal of turn knob 4 and top cover 7 which exposes the top of carousel 2 tubes 3 for product loading.

Figure 3:
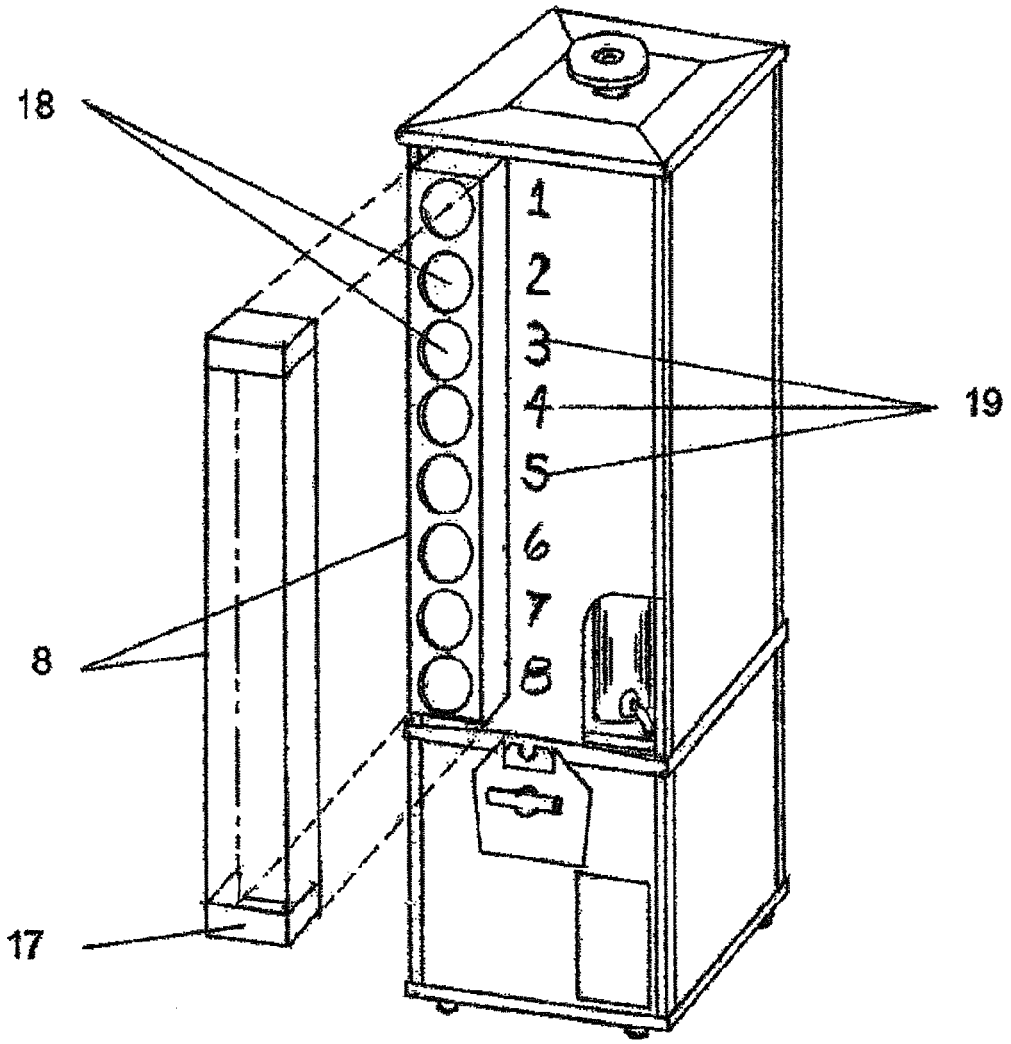
FIG. 3 is view of the selection display module with its cover removed from the machine.

Now with reference to FIGS. 2 and 3, plurality of tubes 3 are numbered in series, e.g. with numbers 19. Machine 1 also includes a display module 8 including individual compartments 18 proximate machine housing 30. Those having skill in the art will appreciate that display module 8 can be integrated with machine housing 30, as shown in FIG. 1, or connected to the exterior of the housing, not shown. The display module 8 attaches to the exterior of machine housing 30 via brackets 17 that interlock with one of the four sides of machine housing 30. In addition, display module 8 can be quickly and easily removed when the top cover 7 of the machine 1 is taken off. The number of individual compartments 18 corresponds with the number of plurality of tubes 3. Each individual compartment 18 is identifiable, e.g. with numbers 19, to correspond with one of the numbered tubes 3. Although shown and described herein using visual identifiers, e.g. numbers, those having skill in the art will appreciate that other identifiers can be used, for example, a non-visual identifier such as Braille, or other visual identifiers such as letters or symbols. In addition, each individual compartment 18 is sized to hold and display a sample of the item that can be dispensed from its corresponding numbered tube 3.

Figure 4:
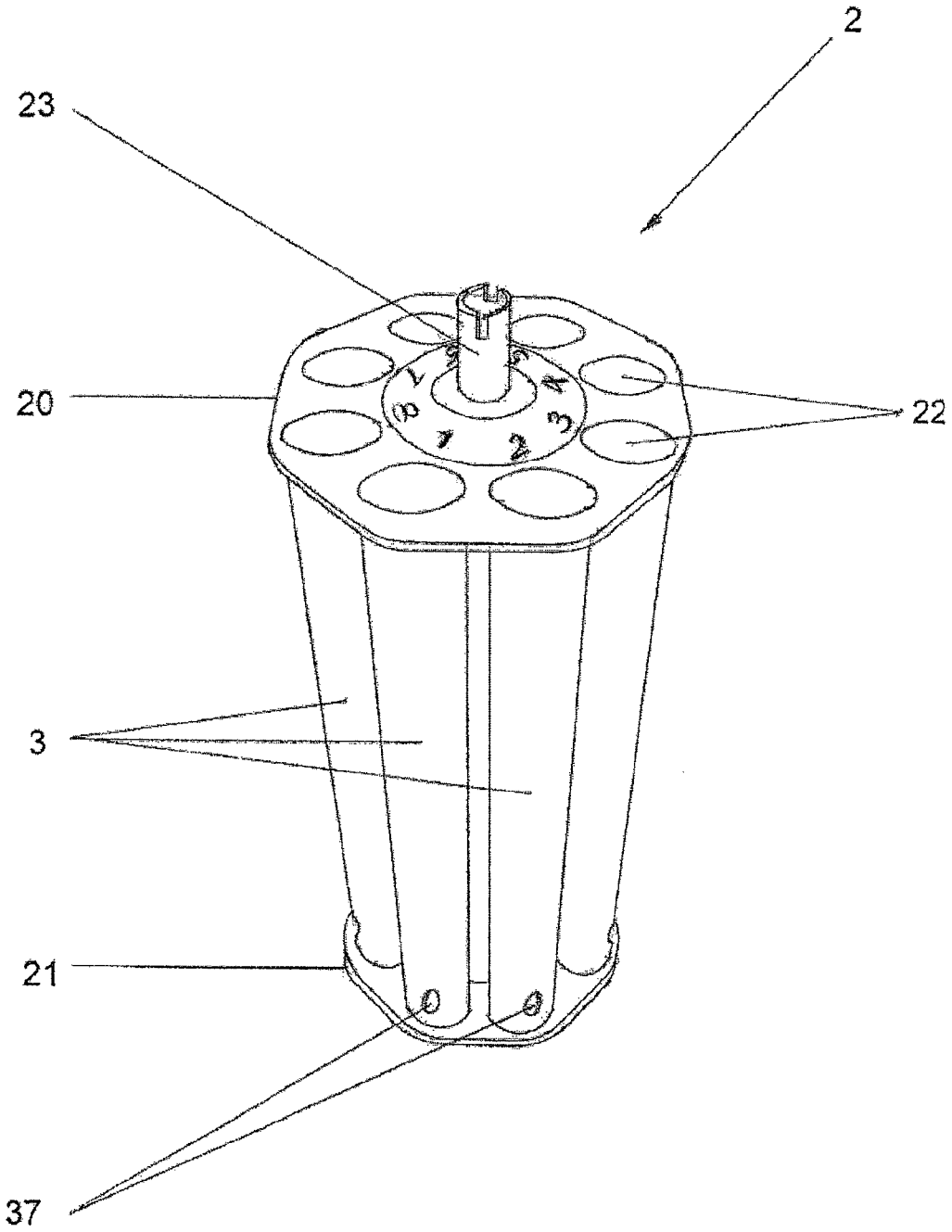
FIG. 4 is a front view of the carousel removed from the machine.
Figure 5:
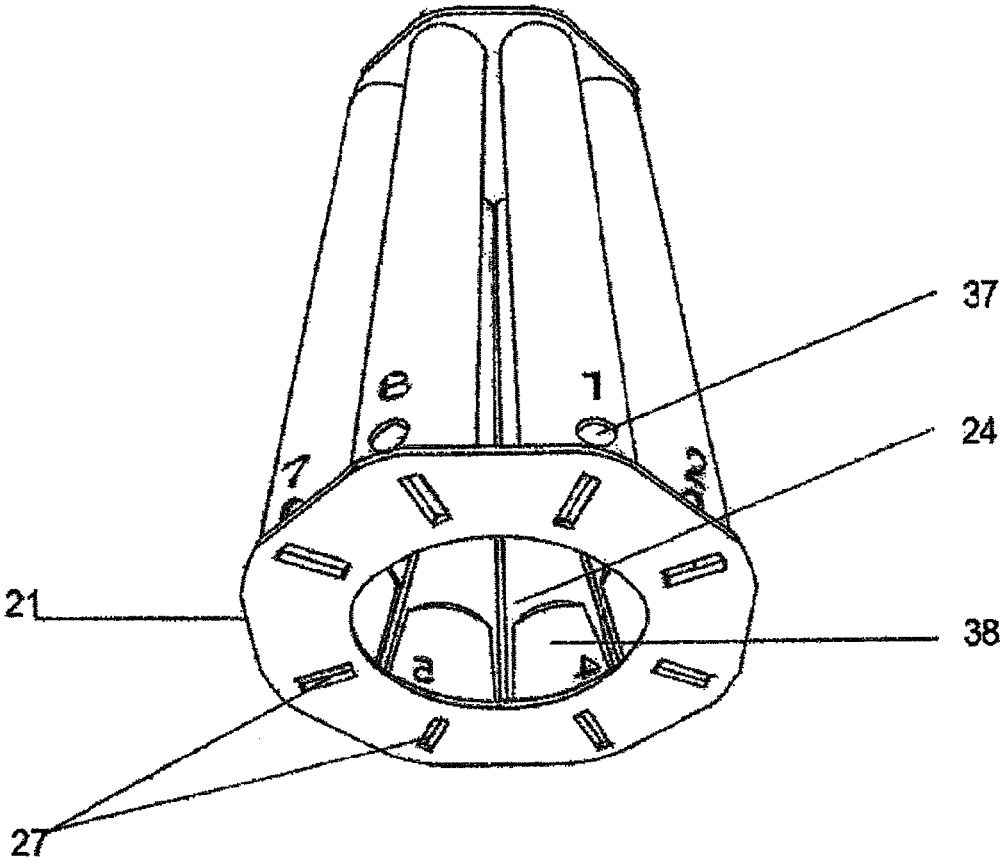
FIG. 5 is a bottom view of the carousel.

In reference to FIGS. 4 and 5, carousel 2 includes opposing top and bottom plates, 20 and 21 respectively, wherein top and bottom plates, 20 and 21, are separated by plurality of tubes 3. Top plate 20, as shown in FIG. 4, is connected to a splined bushing 23 that is connected to turn knob 4, see FIG. 1, and has a series of equally sized and equally spaced holes 22 configured to allow for loading of the articles to be dispensed. In a preferred embodiment, the articles to be dispensed are loaded upside down. Splined bushing 23 and turn knob 4, see FIG. 1, are configured to allow for manual rotation of carousel 2. Each tube 3 of the carousel 2 can accommodate a plurality of shaped pods or articles for dispensing. Bottom plate 21 is ring shaped such that tubes 3 attach to the flat surface of the ring and a center hole 24 of bottom plate 21 operatively fits over hub 25. In addition, bottom plate 21 can include a series of indents 27, see FIG. 5, which are configured and adapted to provide proper indexing for carousel 2.

Now referring to FIG. 5, each tube of plurality of tubes 3 includes a first and second opposing hole, 37 and 38 respectively. First opposing hole 37 is configured to allow ejector arm 10 to pass through, see FIGS. 1 and 7, and second opposing hole 38 is configured and adapted to allow only one item at a time to pass through without machine 1 error. First opposing hole 37 is shaped to be merely sufficient to allow ejector arm 10 to pass through it, while second opposing hole 38 is shaped to ensure the trouble-free discharge of only one article at a time. It is also contemplated that second opposing hole 38 is substantially trapezoidal. The substantially trapezoidal shape assists with the smooth ejection of one item from the selected tube 3, without additional items from the tube 3 being untimely dispensed. Those having skill in the art will appreciate that the shape of opposing hole 38 can be any other suitable diverging tapering shape and can vary depending on the size and shape of the item being dispensed. In addition, plurality of tubes 3 is configured and adapted to allow for a plurality of units to move by gravity through plurality of tubes 3 parallel to housing axis A.

Figure 6:
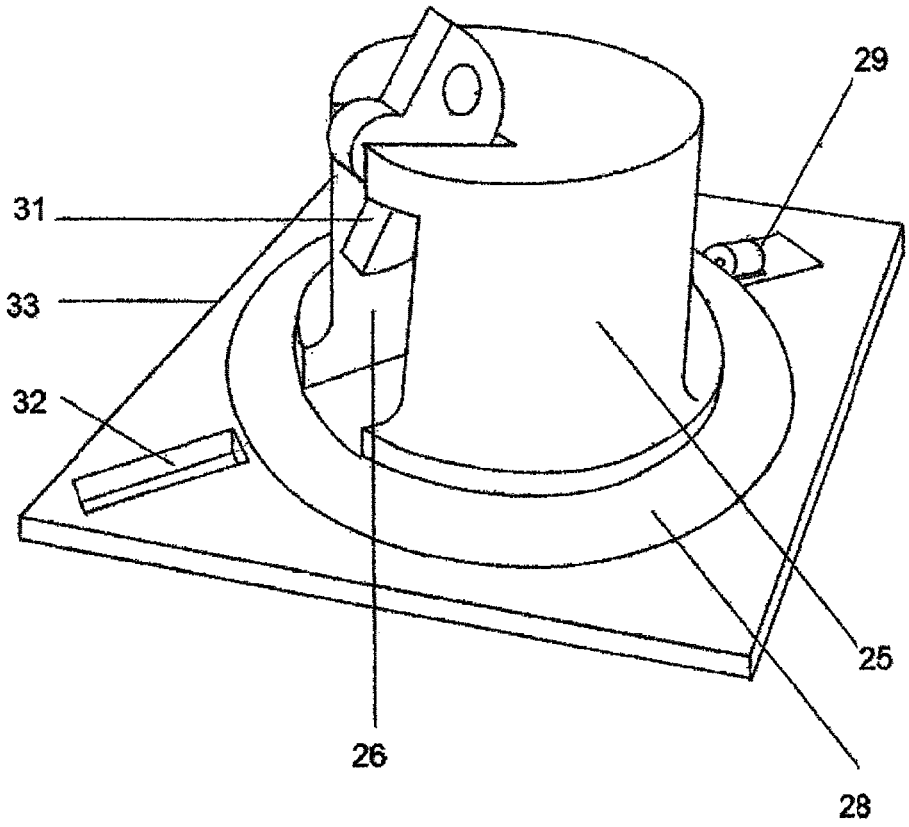
FIG. 6 is a side view of the machine with the machine's top cover and carousel removed.

Now with reference to FIG. 6, machine 1 includes a flat bearing surface 28 on bottom cover 33 of machine housing 30. Bottom cover 33 can include a spring loaded detent 29. Carousel 2 is configured to rotate around hub 25 of bottom cover 33 on flat bearing surface 28, and spring loaded detents 29 are configured and adapted to work with indents 27 in bottom plate 21 to provide indexing for carousel 2. It is also contemplated that carousel 2 is removable. In addition, top cover 7 of machine housing 30 is removable and bottom cover 33 of machine housing 30 is configured and adapted to substantially divide machine housing 30 from machine base 9. Bottom cover 33 includes a slot 32 substantially aligned with ejector arm 10. Slot 32 is configured and adapted to allow ejector arm 10 to rotate from within machine base 9 into machine housing 30 and ultimately push a selected item out of one of plurality of tubes 3 and into hub 25.

In further reference to FIG. 6, hub 25 includes a shaped hole 26 that is configured and adapted to allow one of the items being dispensed to pass through shaped hole 26. The outside diameter of hub is configured to align the carousel within machine housing 30 and keep items contained in tubes 3 as carousel 2 revolves around hub 25. Hub 25 also includes a retainer element 31 operatively connected to hub 25 proximate shaped hole 26 of hub 25. Retainer element 31 configured and adapted to resist an item from passing through shaped hole 26.

Figure 7:
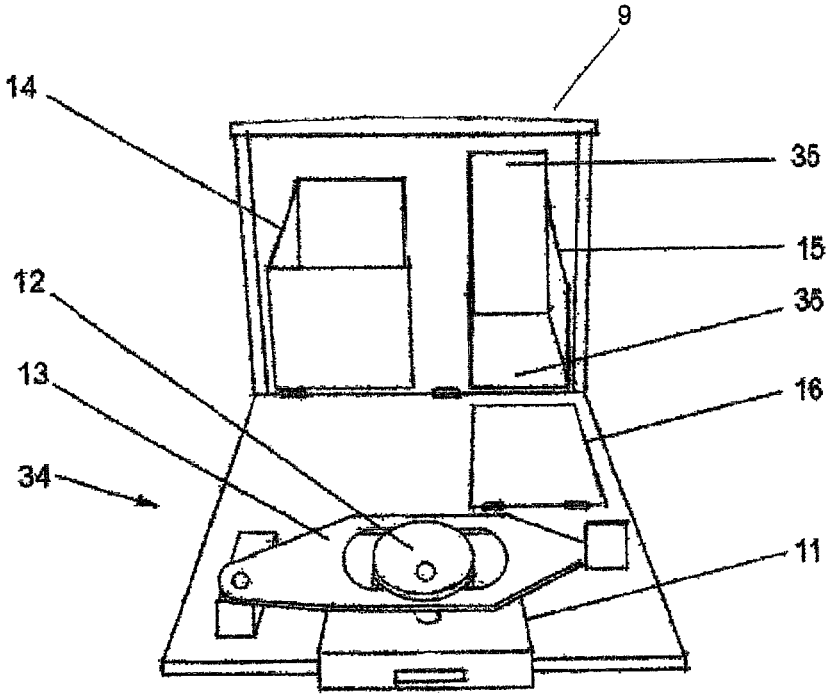
FIG. 7 is a front view of the machine base 9 with the machine base 9 hinged open.

Now referring to FIG. 7, machine 1 also has a mechanical mechanism 34 disposed partially in the interior of machine base 9, see FIG. 1. Machine 1 further includes an ejector arm 10 operatively interfaced with mechanical mechanism 34 within machine base 9. The arched shape of ejector arm 10 assists with the smooth ejection of one unit from machine 1 while helping to keep the article above it in proper alignment. Ejector arm 10 is configured and adapted to push a selected item out of one of plurality of tubes 3 and into hub 25.

In further reference to FIG. 7, mechanical mechanism 34 has an internal actuator cam 12, and a cam follower assembly 13, wherein internal actuator cam 12 and cam follower 13 are operatively connected to one another. Mechanical mechanism 34 is configured and adapted to rotate ejector arm 10 about an ejector arm axis into machine housing 30, whereby the rotation of ejector arm 10 is configured to eject an item from the one of plurality of tubes 3 by pushing the item though a shaped hole in hub 25. In addition, mechanical mechanism 34 includes a coin mechanism 11 proximate the exterior of machine base 9, where internal actuator cam 12, coin mechanism 11, and cam follower 13 are operatively connected to one another. Internal actuator cam 12 is connected to a shaft of coin mechanism 11 and interacts with cam follower 13. Coin mechanism 11 is connected to and configured and adapted to interface with a user and control internal actuator cam 12 and cam follower assembly 13, ultimately interfacing with ejector arm 10. Coin mechanism 11 is configured and adapted to control the movement of internal actuator cam 12 and cam follower assembly 13.

Although described herein as coin mechanism 11, those having skill in the art will readily appreciate that the term "coin" can be used to designate coin currency as well as non-currency coins such as tokens. In addition, those having skill in the art will readily appreciate that retainer element 31, described above with reference to FIG. 6, will permit passage of an item only once the ejector arm has completely pushed the item. For example, the user must completely engage the coin mechanism so that the ejector arm is fully rotated, therein the ejector arm providing enough mechanical force to a unit in order to overcome the resistance provided by the retainer element 31 and pass through shaped hole 26 of hub 25.

With further reference to FIG. 7, it is also contemplated that machine 1 includes a discharge chute 15 disposed within machine base 9, discharge chute 15 including a first end 35 and a second end 36, and a cover flap 16. First end 35 is disposed inside of machine base 9 proximate hub 25 and second end 36 is disposed outside of machine base 9. Cover flap 16 is proximate second end 36. Discharge chute 15 configured and adapted to provide passage for an item from plurality of tubes 3 and hub 25, through discharge chute 15 to dispense outside of machine base 9. Machine 1 also includes a coin box 14 proximate the interior of machine base 9. Coin box 14 is configured and adapted to receive and hold a plurality of coins inserted through coin mechanism 11.

The advantages of the present invention include, without limitation, that it provides an economical, easily transportable, simple to use, non-electrical means for controlling and dispensing small containers, products, and articles of value. The commonly used method of displaying containers such as Keurig© brand K-Cups® in bulk is often subject to theft and abuse.

While the current device has been shown and described with a carousel containing a total of eight tubes of a specific length, it should be noted that proportionately larger or smaller versions of the device could be produced so as to accommodate different quantities and shapes of dispensable items. Thus, the forgoing description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method and examples, but by all embodiments and methods within the scope and spirit of the invention as claimed.

What is claimed is:

1. A machine for storing, displaying and selectively dispensing a plurality of items comprising:

a machine housing defining a housing axis, the machine housing including a top cover and a bottom cover, the bottom cover including a hub;

a machine base operatively connected to the machine housing proximate the bottom cover, including an interior and an exterior;

a carousel disposed within the machine housing along the housing axis, the carousel including a plurality of tubes oriented parallel to the housing axis and including opposing top and bottom plates, wherein the top and bottom plates are separated by the plurality of tubes, the top plate connected to a splined bushing that is connected to a turn knob, the top plate having a series of equally sized and equally spaced holes, and the bottom plate includes a series of indents that are configured and adapted to provide proper indexing of the carousel;

a flat bearing surface on the bottom cover of the machine housing, the flat bearing surface including spring loaded detents, the spring loaded detents configured and adapted to work with the indents in the bottom plate to provide indexing for the carousel;

a mechanical mechanism disposed partially in the interior of the machine base, the mechanical mechanism including an internal actuator cam, and a cam follower assembly, wherein the internal actuator and the cam follower are operatively connected to one another;

an ejector arm operatively interfaced with the mechanical mechanism within the machine base, wherein the mechanical mechanism is configured and adapted to rotate the ejector arm about an ejector arm axis into the machine housing, whereby the rotation of the ejector arm is configured to eject an item from one of the plurality of tubes; and a discharge chute disposed within the machine base, the discharge chute including a first end and a second end, the first end disposed inside of the machine base and the second end outside of the machine base, the discharge chute configured and adapted to provide passage for an item from the plurality of tubes and hub, through the discharge chute to dispense outside of the machine base.

2. The machine as recited in claim 1, further comprising a turn knob operatively connected to the carousel, configured to mechanically move the carousel.

3. The machine as recited in claim 1, further comprising a key lock connected to a central tie rod proximate the top cover and operatively connected to the machine housing, the key lock configured to control access to the machine housing interior.

4. The machine as recited in claim 1, further comprising a coin mechanism proximate the exterior of the machine base.

5. The machine as recited in claim 1, wherein the ejector arm is configured and adapted to push a selected item out of one of the plurality of tubes and into the hub.

6. The machine as recited in claim 4, further comprising a coin box proximate the interior of the machine base, the coin box configured and adapted to receive and hold a plurality of coins inserted through the coin mechanism.

7. The machine as recited in claim 1, wherein the plurality of tubes are numbered in series.

8. The machine as recited in claim 7, further comprising a display module including individual compartments proximate the machine housing, the number of individual compartments corresponding with the number of plurality of tubes, wherein each individual compartment is identifiable to correspond with one of the numbered tubes.

9. The machine as recited in claim 1, wherein the bottom plate is ring shaped and a center hole of the bottom plate is operatively fit over the hub.

10. The machine as recited in claim 1, wherein the hub includes a shaped hole, wherein the shaped hole is configured and adapted to allow one of the items being dispensed to pass through the shaped hole.

11. The machine as recited in claim 10, further comprising a retainer element operatively connected to the hub proximate the shaped hole of the hub, the retainer element configured and adapted to resist an item from passing through the shaped hole.

12. The machine as recited in claim 1, wherein each tube of the plurality of tubes includes a first and second opposing hole, the first opposing hole configured to allow the ejector arm to pass through, the second opposing hole configured and adapted to allow only one unit at a time to pass through without machine error.

13. The machine as recited in claim 12, wherein the second opposing hole is a diverging tapering shape.

14. The machine as recited in claim 1, wherein the plurality of tubes are configured and adapted to allow for a plurality of units to move by gravity through the plurality of tubes parallel to the housing axis.

15. The machine as recited in claim 1, wherein the top cover of the machine housing is removable and the bottom cover of the machine housing is configured and adapted to substantially divide the machine housing from the machine base.

16. The machine as recited in claim 1, wherein the bottom cover of the machine housing further includes a slot substantially aligned with the ejector arm, wherein the slot is configured and adapted to allow the ejector arm to rotate from within the machine base into the machine housing.

17. A machine for storing, displaying and selectively dispensing a plurality of items comprising:

a machine housing defining a housing axis, the machine housing including a removable top cover and a bottom cover, the bottom cover including a hub and a slot, the hub including a shaped hole and a retainer element proximate the shaped hole;

a machine base operatively connected to the machine housing, including an interior and an exterior, and a coin box proximate the interior of the machine base;

a removable carousel disposed within the machine housing along the housing axis, the carousel including a plurality of tubes oriented parallel to the housing axis, and opposing top and bottom plates, wherein each of the plurality of tubes includes a first and second opposing hole, wherein the second opposing hole is substantially trapezoidal, and the top and bottom plates are separated by the plurality of tubes, wherein the top plate has a series of equally sized and equally spaced holes and the bottom plate is ring shaped and a center hole of the bottom plate is operatively fit over the hub;

a mechanical mechanism disposed partially in the interior of the machine base, the mechanical mechanism including an internal actuator cam, a coin mechanism, and a cam follower assembly, wherein the internal actuator cam, the coin mechanism, and the cam follower are operatively connected to one another;

an ejector arm operatively interfaced with the mechanical mechanism within the machine base, the ejector arm substantially aligned with and proximate to the slot in the bottom cover, wherein the mechanical mechanism is configured and adapted to rotate the ejector arm about an ejector arm axis, whereby the rotation of the ejector arm is configured to push a selected item out of one of the plurality of tubes and into the hub;

a discharge chute disposed within the machine base, the discharge chute including a first end and a second end, the first end disposed inside of the machine base and the second end outside of the machine base; and a turn knob operatively connected to the removable carousel.

18. The machine as recited in claim 1, wherein the mechanical mechanism includes an internal actuator cam, and a cam follower assembly, and wherein the internal actuator cam and the cam follower assembly are operatively connected to one another.

19. The machine as recited in claim 13, wherein the diverging tapering shape is substantially trapezoidal.

* * * * *